US010330272B2

(12) United States Patent
Chung

(10) Patent No.: US 10,330,272 B2
(45) Date of Patent: Jun. 25, 2019

(54) ADJUSTABLE FIXING STRUCTURE AND ILLUMINATION APPARATUS

(71) Applicants: LITE-ON ELECTRONICS (GUANGZHOU) LIMITED, Guangzhou (CN); Lite-On Technology Corporation, Taipei (TW)

(72) Inventor: Fu-Chin Chung, Taipei (TW)

(73) Assignees: LITE-ON ELECTRONICS (GUANGZHOU) LIMITED, Guangzhou (CN); Lite-On Technology Corporation, Taipei (TW)

( * ) Notice: Subject to any disclaimer, the term of this patent is extended or adjusted under 35 U.S.C. 154(b) by 274 days.

(21) Appl. No.: 15/408,422

(22) Filed: Jan. 18, 2017

(65) Prior Publication Data

US 2018/0172253 A1 Jun. 21, 2018

(30) Foreign Application Priority Data

Dec. 19, 2016 (CN) ..... 2016 1 1174923

(51) Int. Cl.
*F21S 8/08* (2006.01)
*F21V 21/116* (2006.01)
*F21W 131/103* (2006.01)

(52) U.S. Cl.
CPC ..... *F21S 8/086* (2013.01); *F21V 21/116* (2013.01); *F21W 2131/103* (2013.01)

(58) Field of Classification Search
CPC . F21S 8/086; F21S 8/085; F21S 8/088; F21V 21/116; F21W 2131/103; B25B 1/08; F16B 2/14; F16B 2/18; F16B 2/06; F16B 2/065; F16B 2/185; F16L 3/08
USPC ..... 248/218.4, 411–412, 222.13–222.14, 248/230.2, 229.11, 229.21, 228.2, 231.31, 248/230.1, 219.3–219.4; 254/391, 395; 188/65.1, 65.3, 65.7, 67
See application file for complete search history.

(56) References Cited

U.S. PATENT DOCUMENTS 778,048 A * 12/1904 Krebs ..... F16B 2/14 403/374.2
3,142,501 A * 7/1964 Clark ..... F21V 21/116 248/230.1
3,387,866 A * 6/1968 Baldwin ..... F21S 8/086 248/230.3
3,492,702 A * 2/1970 Stafford ..... F16G 11/101 182/5
3,811,155 A * 5/1974 Stafford ..... A62B 1/14 182/5

(Continued)

*Primary Examiner* — Christopher Garft
(74) *Attorney, Agent, or Firm* — JCIPRNET

(57) ABSTRACT

An adjustable fixing structure includes a main body, a first fixing element and at least one second fixing element. The main body has a containing space, a containing cavity communicating with the containing space and at least one opening communicating with the containing space. The opening is disposed corresponding to the containing cavity, and a light shaft is adapted to be disposed in the containing space. The first fixing element is movably disposed in the containing cavity of the main body. The second fixing element is movably disposed in the opening of the main body. The first and the second fixing elements are moved along an axis to lean against the light shaft, so as to fix the light shaft in the containing space.

10 Claims, 5 Drawing Sheets

(56) References Cited

U.S. PATENT DOCUMENTS

| | | | | |
|---|---|---|---|---|
| 4,199,178 | A * | 4/1980 | Coats | E05B 17/0025 292/205 |
| 4,426,676 | A * | 1/1984 | Taylor | F21S 8/086 362/371 |
| 4,508,479 | A * | 4/1985 | Mez | F16B 21/10 411/340 |
| 6,095,502 | A * | 8/2000 | Dodge, Jr. | A62B 1/14 182/5 |
| 8,297,792 | B1 * | 10/2012 | Wang | F21S 8/086 362/249.03 |
| 2010/0097815 | A1 * | 4/2010 | Song | F21S 8/086 362/418 |
| 2010/0309673 | A1 * | 12/2010 | Liu | F21S 8/086 362/427 |
| 2011/0057081 | A1 * | 3/2011 | Shiau | F21V 17/12 248/219.4 |
| 2011/0058368 | A1 * | 3/2011 | Shiau | F21V 14/02 362/225 |
| 2011/0063828 | A1 * | 3/2011 | Ku | F21V 21/116 362/217.16 |
| 2017/0167676 | A1 * | 6/2017 | Wang | F21S 8/086 |

* cited by examiner

ADJUSTABLE FIXING STRUCTURE AND ILLUMINATION APPARATUS

CROSS-REFERENCE TO RELATED APPLICATION

This application claims the priority benefit of China application serial no. 201611174923.4, filed on Dec. 19, 2016. The entirety of the above-mentioned patent application is hereby incorporated by reference herein and made a part of this specification.

BACKGROUND OF THE INVENTION

Field of the Invention

The invention relates to a fixing structure and an illumination apparatus and more particularly, to an adjustable fixing structure and an illumination apparatus using the adjustable fixing structure.

Description of Related Art

In a design of a street lamp of the related art, a light shaft fixing holder is disposed on a side of the lamp and used to fix a light shaft. Generally speaking, a size (i.e., a bore diameter) of the light shaft fixing holder of the related art may be substantially classified into to three types i.e., 48 mm, 60 mm and 76 mm, and a suitable light shaft fixing holder may be selected according to the size of the light shaft. That is to say, during the installation process of the street lamp, in the presence of light shaft with a different size, the light shaft fixing holder originally disposed on the lamp has to be replaced with a suitable light shaft fixing holder, thereby fixing the light shaft to the lamp through the light shaft fixing holder. In this way, the installation and use become more inconvenient.

SUMMARY OF THE INVENTION

The invention provides an adjustable fixing structure capable of fixing various light shafts with different sizes.

The invention further provides an illumination apparatus including the adjustable fixing structure capable of fixing various light shafts with different sizes on a lamp.

An adjustable fixing structure of the invention is adapted to be disposed on a lamp of an illumination apparatus to fix a light shaft of the illumination apparatus. The adjustable fixing structure includes a main body, a first fixing element and at least one second fixing element. The main body has a containing space, a containing cavity communicating with the containing space and at least one opening communicating with the containing space. The at least one opening is disposed correspondingly to the containing cavity, and the light shaft is adapted to be disposed in the containing space. The first fixing element is movably disposed in the containing cavity of the main body. The at least one second fixing element is movably disposed in the opening of the main body. The first fixing element and the at least one second fixing element are moved along an axis to respectively lean against the light shaft, so as to fix the light shaft in the containing space.

In an embodiment of the invention, the main body has a plurality of fixing holes which communicate with the containing cavity and are opposite to one another, and the first fixing element includes a positioning plate and at least one first locking unit. The positioning plate has a plurality of positioning holes with different heights. The first locking unit sequentially penetrates through one of the fixing holes of the main body, one of the positioning holes and another one of the fixing holes of the main body, so as to position the positioning plate in the containing cavity of the main body.

In an embodiment of the invention, a moving direction of the positioning plate is perpendicular to a locking direction of the first locking unit.

In an embodiment of the invention, a fixing portion is on a side of the main body, and a bore diameter of the light shaft is proportional to a distance of the positioning plate with respect to the fixing portion.

In an embodiment of the invention, the positioning holes with different heights define a step-like positioning hole.

In an embodiment of the invention, a vertical distance is between the first fixing element and the second fixing element, and the vertical distance is proportional to the bore diameter of the light shaft.

An illumination apparatus of the invention includes a lamp, a light shaft and an adjustable fixing structure. The adjustable fixing structure is disposed on the lamp to fix the light shaft. The adjustable fixing structure includes a main body, a first fixing element and at least one second fixing element. The main body has a containing space, a containing cavity communicating with the containing space and at least one opening communicating with the containing space. The at least one opening is disposed correspondingly to the containing cavity, and the light shaft is adapted to be disposed in the containing space. The first fixing element is movably disposed in the containing cavity of the main body. The at least one second fixing element is movably disposed in the opening of the main body. The first fixing element and the at least one second fixing element are moved along an axis to respectively lean against the light shaft, so as to fix the light shaft in the containing space.

In an embodiment of the invention, the main body has a plurality of fixing holes which communicate with the containing cavity and are opposite to one another, and the first fixing element includes a positioning plate and at least one first locking unit. The positioning plate has a plurality of positioning holes with different heights. The first locking unit sequentially penetrates through one of the fixing holes of the main body, one of the positioning holes and another one of the fixing holes of the main body, so as to position the positioning plate in the containing cavity of the main body.

In an embodiment of the invention, a moving direction of the positioning plate is perpendicular to a locking direction of the first locking unit.

In an embodiment of the invention, a fixing portion is on a side of the main body, and a bore diameter of the light shaft is proportional to a distance of the positioning plate with respect to the fixing portion.

In an embodiment of the invention, the positioning holes with different heights define a step-like positioning hole.

In an embodiment of the invention, a vertical distance is between the first fixing element and the second fixing element, and the vertical distance is proportional to the bore diameter of the light shaft.

To sum up, the first fixing element and the at least one second fixing element of the adjustable fixing structure of the invention are moved along an axis to respectively lean against the light shaft located in the containing space of the main body. Therefore, all light shafts with the sizes that allows them to be disposed in the containing space of the main body can be fixed in the containing space of the main body by the first fixing element and the at least one second fixing element. In other words, the adjustable fixing structure of the invention can be used to fix various light shafts with different sizes. As being compared with the related art in which various light shafts with different sizes have to be fixed by using the light shaft fixing holders with different sizes, the adjustable fixing structure of the invention can achieve preferable use convenience and flexibility to effectively reduce development cost and enhance product competitiveness in the market.

In order to make the aforementioned and other features and advantages of the invention more comprehensible, several embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1A:
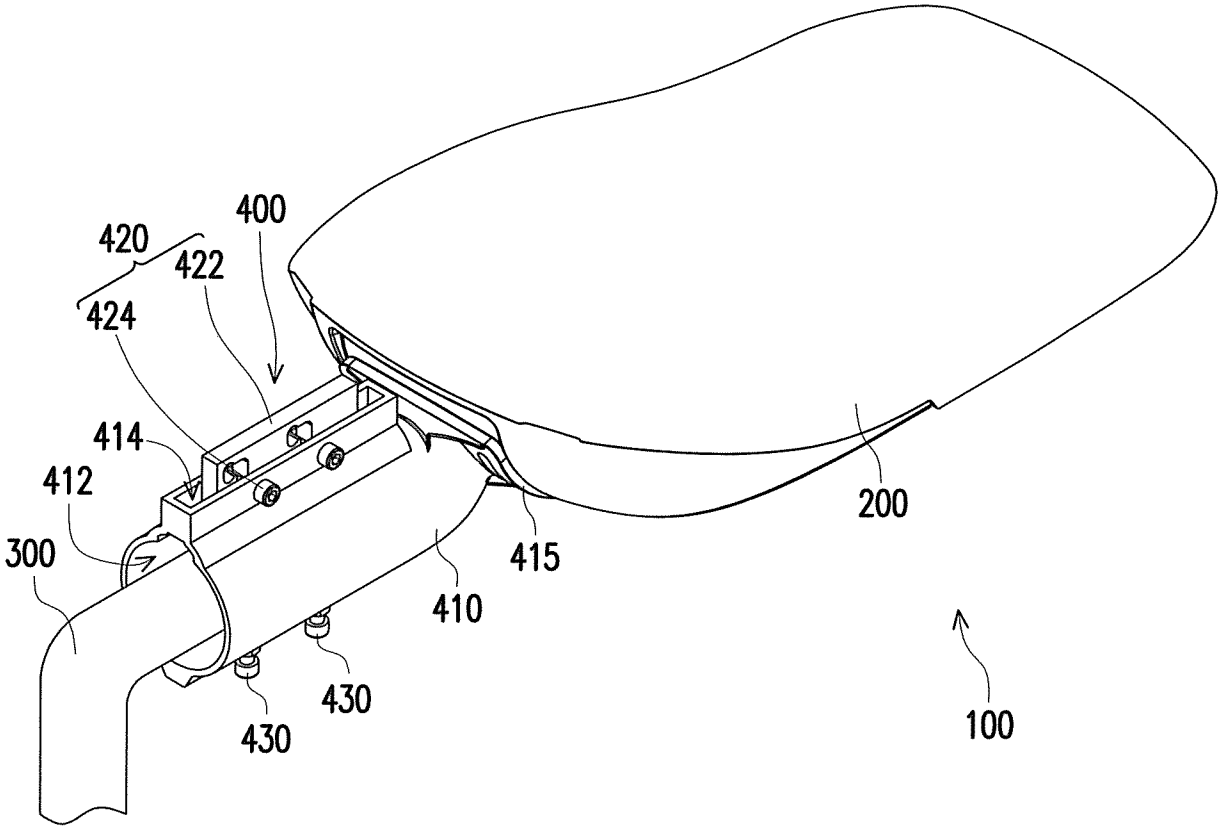
FIG. 1A is a schematic partial perspective view showing an illumination apparatus according to an embodiment of the invention.
Figure 1B:
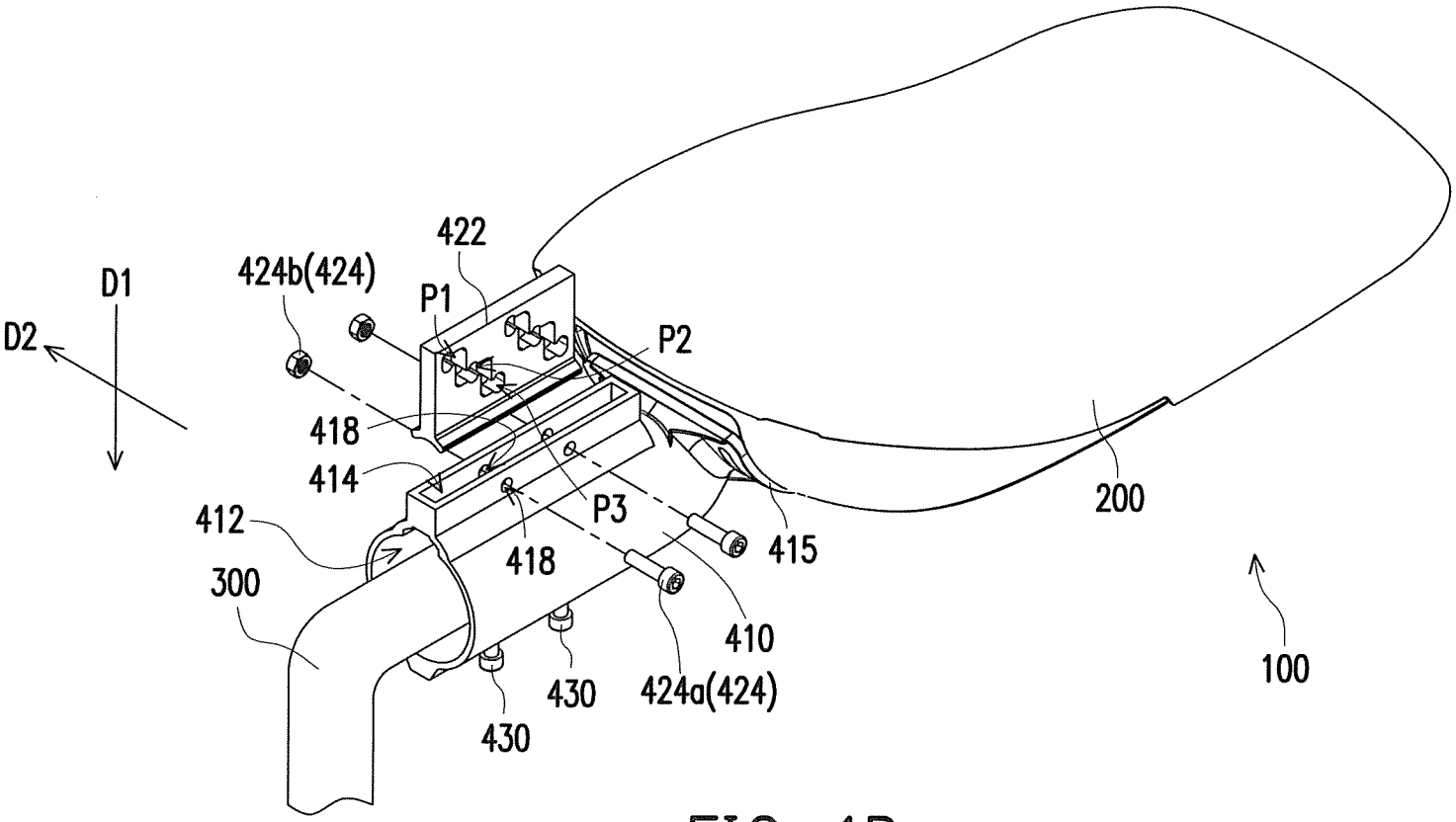
FIG. 1B is a schematic exploded view showing a part of elements of an adjustable fixing structure of the illumination apparatus depicted in FIG. 1A.
Figure 2A:
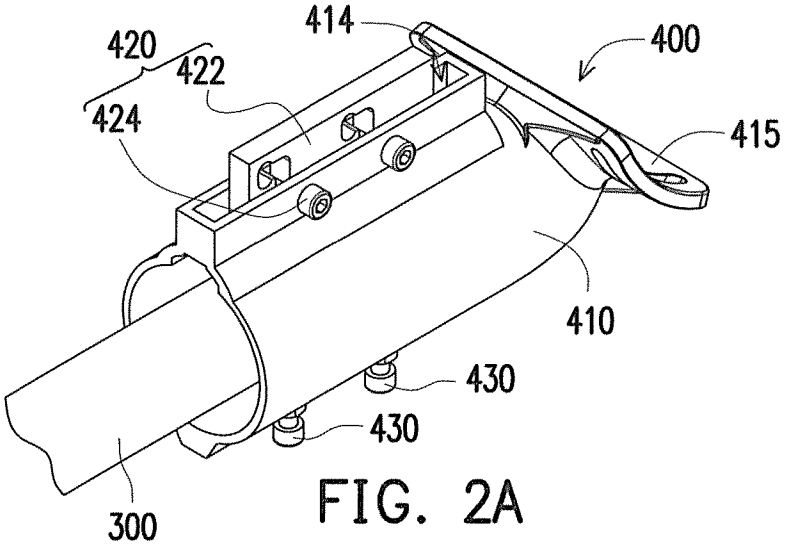
FIG. 2A is a schematic perspective view of a light shaft fixed by the adjustable fixing structure depicted in FIG. 1A.
Figure 2C:
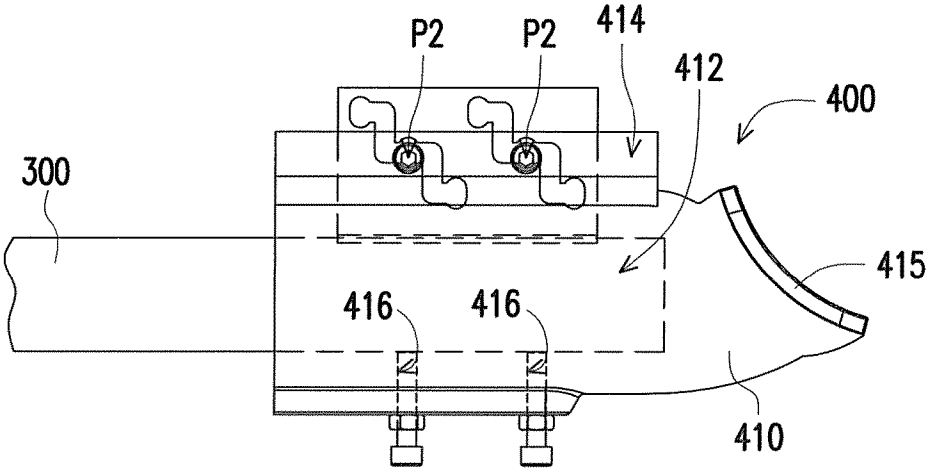
FIG. 2C is a schematic cross-sectional view of FIG. 2A.
Figure 2B:
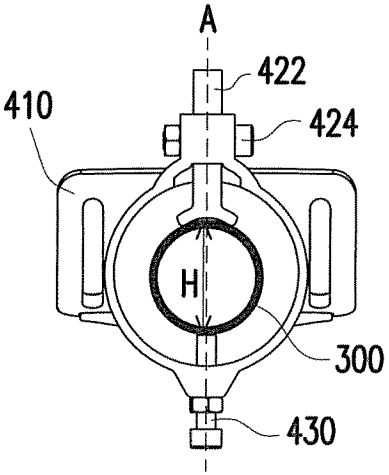
FIG. 2B is a schematic side view of FIG. 2A.

FIG. 1A is a schematic partial perspective view showing an illumination apparatus according to an embodiment of the invention. FIG. 1B is a schematic exploded view showing a part of elements of an adjustable fixing structure of the illumination apparatus depicted in FIG. 1A. FIG. 2A is a schematic perspective view of a light shaft fixed by the adjustable fixing structure depicted in FIG. 1A. FIG. 2B is a schematic side view of FIG. 2A. FIG. 2C is a schematic cross-sectional view of FIG. 2A.

Referring to both FIG. 1A and FIG. 1B first, an illumination apparatus 100 includes a lamp 200, a light shaft 300 and an adjustable fixing structure 400. The adjustable fixing structure 400 is disposed on the lamp 200, so as to fix the light shaft 300. The lamp 200 may include a plurality of light emitting units (not shown) used to emit light for illumination. One end of the light shaft 300 is fixed by the adjustable fixing structure 400, and the other end of light shaft 300 is fixed onto the ground. In this case, the illumination apparatus 100 is, for example, a street lamp, but the invention is not limited thereto.

Referring to FIG. 2A, FIG. 2B and FIG. 2C, the adjustable fixing structure 400 includes a main body 410, a first fixing element 420 and at least one second fixing element 430 (schematically illustrated as two herein). The main body 410 has a containing space 412, a containing cavity 414 communicating with the containing space 412 and at least one opening 416 (schematically illustrated as two herein) communicating with the containing space 412. The openings 416 are disposed correspondingly to the containing cavity 414, and the light shaft 300 is adapted to be disposed in the containing space 412. The first fixing element 420 is movably disposed in the containing cavity 414 of the main body 410. The second fixing elements 430 are movably disposed in the openings 416 of the main body 410. The first fixing element 420 and the second fixing elements 430 are moved along an axis A to respectively lean against the light shaft 300, so as to fix the light shaft 300 in the containing space 412.

Specifically, referring to FIG. 1B again, the main body 410 of the adjustable fixing structure 400 of the present embodiment has a plurality of fixing holes 418 (schematically illustrated as four herein) which communicate with the containing cavity 414 and are opposite to one another, and the first fixing element 420 includes a positioning plate 422 and at least one first locking unit 424 (schematically illustrated as two herein). The positioning plate 422 has a plurality of positioning holes P1, P2 and P3 with different heights. The positioning hole P2 is located between the positioning hole P1 and the positioning hole P3, a vertical height of the positioning hole P1 with respect to the light shaft 300 is greater than a vertical height of the positioning hole P3 with respect to the light shaft 300. Herein, the positioning holes P1, P2 and P3 with different heights on the positioning plate 422 may define a step-like positioning hole, and the light shaft 300 may be positioned in one of the positioning holes P1, P2 and P3 with different heights according to a bore diameter of the light shaft 300.

Additionally, the first locking unit 424 is embodied as being composed of a screw bolt 424*a* and a screw nut 424*b*, but the invention is not limited thereto. Each of the first locking units 424 sequentially penetrates through one of the fixing holes 418 of the main body 410, the positioning hole P2 (or the positioning hole P1 or the positioning hole P3) and another one of the fixing hole 418 of the main body 410, so as to position the positioning plate 422 in the containing cavity 414 of the main body 410. Each of the second fixing elements 430 is also embodied as a combination of a screw bolt and a screw nut, but the invention is not limited thereto. In addition, a fixing portion 415 is provided on a side of the main body 410 of the adjustable fixing structure 400, and the fixing portion 415 is locked onto the lamp 200 through a screw, so as to fix the adjustable fixing structure 400 to the lamp 200.

As illustrated in FIG. 1B, FIG. 2A, FIG. 2B and FIG. 2C, a moving direction D1 of the positioning plate 422 of the first fixing element 420 is perpendicular to a locking direction D2 of each of the first locking units 424 in the present embodiment. Namely, the positioning plate 422 of the first fixing element 420 is inserted into the containing cavity 414 along the moving direction D1, the positioning plate 422 is locked to the main body 410 along the locking direction D2 by the first locking units 424, and the moving direction D1 and the locking direction D2 are substantially perpendicular to each other. When the light shaft 300 is inserted in the containing space 412 of the main body 410 of the adjustable fixing structure 400, the positioning plate 422 of the first fixing element 420 is moved down (in the same direction as the moving direction D1) along the axis A to lean against the light shaft 300, and the second fixing elements 430 are moved upward along the axis A to lean against the light shaft 300. Then, the positioning plate 422 is locked to the main body 410 along the locking direction D2 by the first locking units 424, the second fixing elements 430 are also locked onto the main body 410 along the direction of the axis A, so as to fix the light shaft 300 in the containing space 412 of the main body 410 of the adjustable fixing structure 400.

In addition, referring FIG. 2A, FIG. 2C, FIG. 3A, FIG. 3C, FIG. 4A and FIG. 4C simultaneously, bore diameters of light shafts 300, 300' and 300" are proportional to a distance of the positioning plate 422 with respect to the fixing portion 415. As the positioning holes P1, P2 and P3 with different heights on the positioning plate 422 define a step-like positioning hole in the present embodiment, positions of the positioning holes P1, P2 and P3 vary with the light shafts 300, 300' and 300" having different bore diameters. As a result, as the bore diameter of one of the light shafts 300, 300' and 300" (for example, the light shaft 300') increases, the distance of the positioning plate 422 with respect to the fixing portion 415 becomes far (i.e., the first locking unit 424 is locked in the positioning hole P3). Otherwise, as the bore diameter of one of the light shafts 300, 300' and 300" (for example, the light shaft 300") decreases, the distance of the positioning plate 422 with respect to the fixing portion 415 becomes close (i.e., the first locking unit 424 is locked in the positioning hole P1).

Figure 3A:
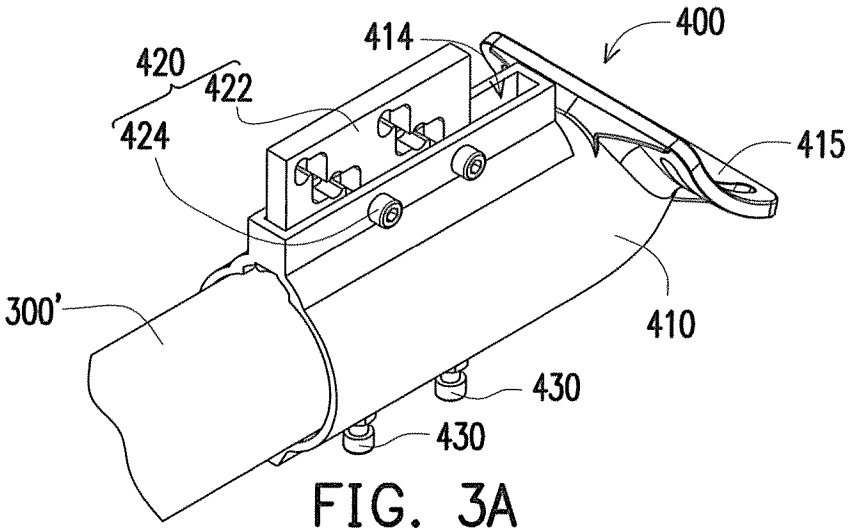
FIG. 3A is a schematic perspective view of a light shaft fixed by an adjustable fixing structure of another embodiment.
Figure 3C:
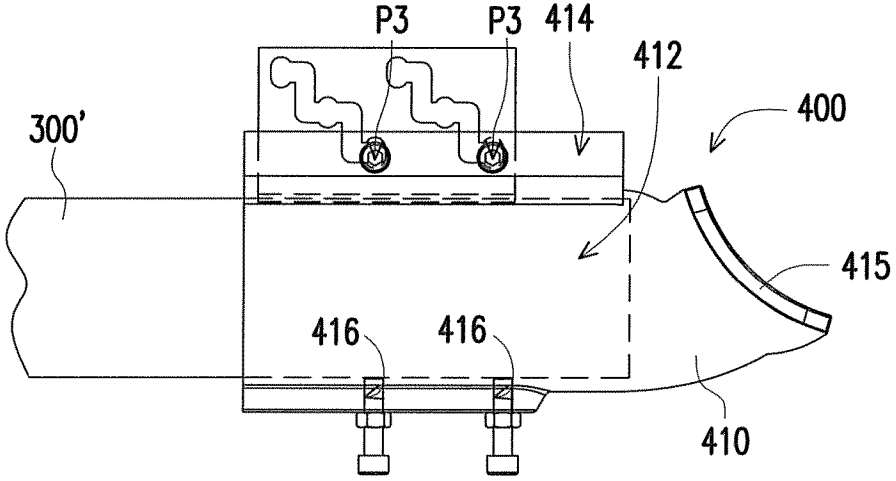
FIG. 3C is a schematic cross-sectional view of FIG. 3A.
Figure 3B:
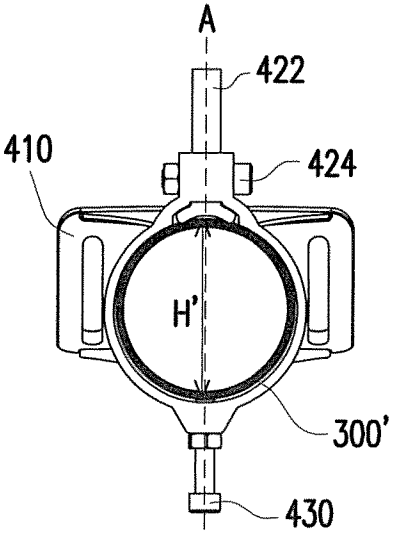
FIG. 3B is a schematic side view of FIG. 3A.
Figure 4A:
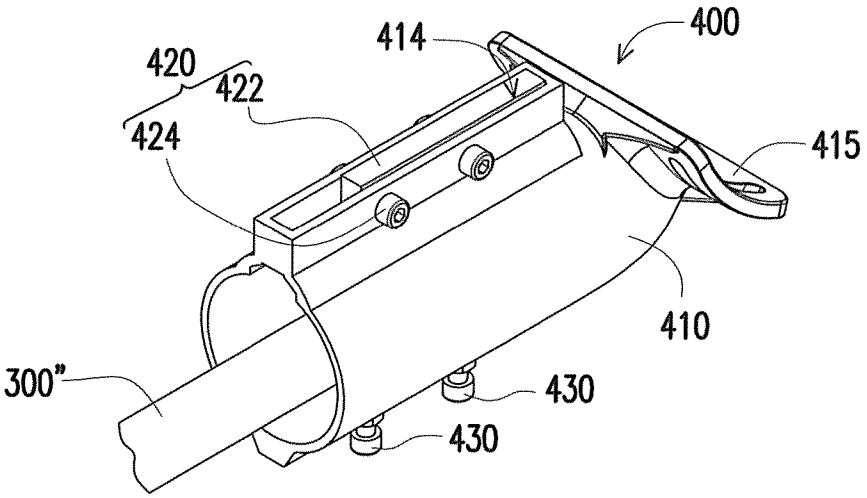
FIG. 4A is a schematic perspective view of a light shaft fixed by an adjustable fixing structure of another embodiment.
Figure 4C:
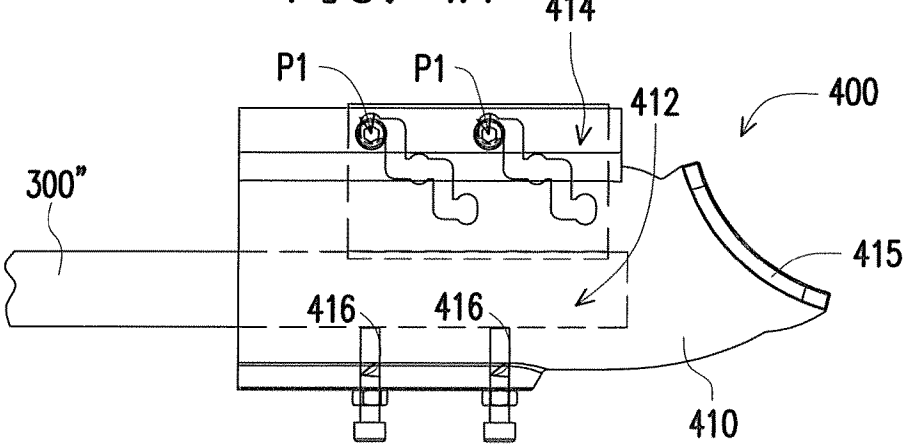
FIG. 4C is a schematic side view of FIG. 4A.
Figure 4B:
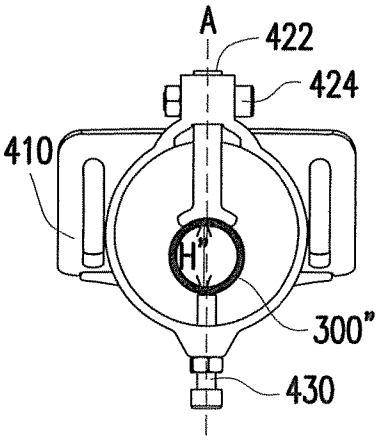
FIG. 4B is a schematic side view of FIG. 4A.

Additionally, referring to FIG. 2B, FIG. 3B and FIG. 4B simultaneously, a vertical distance H, H' or H" is between the first fixing element 420 and each of the second fixing elements 430, and each of the vertical distances H, H' and H" is proportional to the bore diameter of each of the light shafts 300, 300' and 300". Actually, the vertical distances H, H' and H" are approximately equal to the bore diameters of light shafts 300, 300' and 300" and are variable values. Thus, as the bore diameter of one of the light shafts 300, 300' and 300" (for example, the light shaft 300') increases, the vertical distance H, H' or H" (for example, the vertical distance H') between the first fixing element 420 and the second fixing element 430 increases. Otherwise, as the bore diameter of one of the light shafts 300, 300' and 300" (for example, the light shaft 300") increases, the vertical distance H, H' or H" (for example, the vertical distance H") between the first fixing element 420 and the second fixing element 430 also decreases.

In brief, through the design of the adjustable fixing structure 400 of the present embodiment, each of the light shafts 300, 300' and 300" with difference sizes may be fixed through the adjustable fixing structure 400 of the present embodiment, which provides preferable use convenience and flexibility. Moreover, the illumination apparatus 100 using the adjustable fixing structure 400 of the present embodiment may achieve effectively reducing development cost and enhancing product competitiveness in the market.

In light of the foregoing, the first fixing element and the second fixing elements of the adjustable fixing structure of the invention are moved along an axis to respectively lean against the light shaft located in the containing space of the main body. Therefore, all the light shafts with the sizes that allows them to be disposed in the containing space of the main body can be fixed in the containing space of the main body by the first fixing element and the second fixing elements. In other words, the adjustable fixing structure of the invention can be used to fix various light shafts with different sizes. As being compared with the related art in which various light shafts with different sizes have to be fixed by using light shaft fixing holders with different sizes, the adjustable fixing structure of the invention can achieve preferable use convenience and flexibility to effectively reduce development cost and enhance product competitiveness in the market.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An adjustable fixing structure, adapted to be disposed on a lamp of an illumination apparatus to fix a light shaft of the illumination apparatus, the adjustable fixing structure comprising:
   - a main body, having a containing space, a containing cavity communicating with the containing space and at least one opening communicating with the containing space, wherein the at least one opening is disposed correspondingly to the containing cavity, and the light shaft is adapted to be disposed in the containing space;
   - a first fixing element, movably disposed in the containing cavity of the main body; and
   - at least one second fixing element, movably disposed in the opening of the main body, wherein the first fixing element and the at least one second fixing element are moved along an axis to respectively lean against the light shaft, so as to fix the light shaft in the containing space;
   - wherein the main body has a plurality of fixing holes which communicate with the containing cavity and are opposite to one another, the first fixing element comprises a positioning plate and at least one first locking unit, the positioning plate has a plurality of positioning holes with different heights, and the first locking unit sequentially penetrates through one of the fixing holes of the main body, one of the positioning holes and another one of the fixing holes of the main body, so as to position the positioning plate in the containing cavity of the main body.

2. The adjustable fixing structure as recited in claim 1, wherein a moving direction of the positioning plate is perpendicular to a locking direction of the first locking unit.

3. The adjustable fixing structure as recited in claim 1, wherein a fixing portion is on a side of the main body, and a bore diameter of the light shaft is proportional to a distance of the positioning plate with respect to the fixing portion.

4. The adjustable fixing structure as recited in claim 1, wherein the positioning holes with different heights define a step-like positioning hole.

5. The adjustable fixing structure as recited in claim 1, wherein a vertical distance is between the first fixing element and the second fixing element, and the vertical distance is proportional to the bore diameter of the light shaft.

6. An illumination apparatus, comprising:
   - a lamp;
   - a light shaft; and
   - an adjustable fixing structure, disposed on the lamp to fix the light shaft and comprising:
     - a main body, having a containing space, a containing cavity communicating with the containing space and at least one opening communicating with the containing space, wherein the at least one opening is disposed correspondingly to the containing cavity, and the light shaft is adapted to be disposed in the containing space;

a first fixing element, movably disposed in the containing cavity of the main body; and at least one second fixing element, movably disposed in the opening of the main body, wherein the first fixing element and the at least one second fixing element are moved along an axis to respectively lean against the light shaft, so as to fix the light shaft in the containing space;

wherein the main body has a plurality of fixing holes which communicate with the containing cavity and are opposite to one another, the first fixing element comprises a positioning plate and at least one first locking unit, the positioning plate has a plurality of positioning holes with different heights, and the first locking unit sequentially penetrates through one of the fixing holes of the main body, one of the positioning holes and another one of the fixing holes of the main body, so as to position the positioning plate in the containing cavity of the main body.

7. The illumination apparatus as recited in claim 6, wherein a moving direction of the positioning plate is perpendicular to a locking direction of the first locking unit.

8. The illumination apparatus as recited in claim 6, wherein a fixing portion is on a side of the main body, and a bore diameter of the light shaft is proportional to a distance of the positioning plate with respect to the fixing portion.

9. The illumination apparatus as recited in claim 6, wherein the positioning holes with different heights define a step-like positioning hole.

10. The illumination apparatus as recited in claim 6, wherein a vertical distance is between the first fixing element and the second fixing element, and the vertical distance is proportional to the bore diameter of the light shaft.

* * * * *